US006354471B2

(12) United States Patent
Fujii

(10) Patent No.: US 6,354,471 B2
(45) Date of Patent: Mar. 12, 2002

(54) LIQUID MATERIAL DISPENSING APPARATUS

(75) Inventor: Hideyo Fujii, Tokyo (JP)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/725,988

(22) Filed: Nov. 29, 2000

(30) Foreign Application Priority Data

Dec. 3, 1999 (JP) ..... 11-376308

(51) Int. Cl.[7] ..... B67D 5/00; B65D 88/54

(52) U.S. Cl. ..... 222/380; 222/504; 222/325; 222/559; 222/397

(58) Field of Search ..... 222/504, 389, 222/387, 325, 326, 327, 559, 394, 397, 180, 181.1, 380

(56) References Cited

U.S. PATENT DOCUMENTS 3,982,724 A * 9/1976 Citrin ..... 222/46
4,437,586 A * 3/1984 Columbus ..... 222/181
4,848,606 A * 7/1989 Taguchi et al. ..... 222/333
4,922,852 A * 5/1990 Price ..... 222/55
5,074,443 A * 12/1991 Fujii et al. ..... 222/639

FOREIGN PATENT DOCUMENTS

JP 5-9099 7/1990

* cited by examiner

*Primary Examiner*—Kevin Shaver
*Assistant Examiner*—Stephanie L. Willatt
(74) *Attorney, Agent, or Firm*—Wood, Herron & Evans, L.L.P.

(57) ABSTRACT

A liquid dispenser with a syringe reservoir including: (a.) a frame (1) formed by upper bracket (2) and lower bracket (3); (b.) a body (5) that is removable at the frame's upper bracket (2) and provided at its upper end with a threaded part for installing an actuator (6) and provided at its lower end with an insertion part for insertion into a syringe (14) and an installation part for an attachment (16), (c.) an actuator (6) installed at the threaded part provided at the upper end of the aforesaid body (5), (d.) a valve stem (12) operated by the aforesaid actuator, and (e.) a valve seat member (15) installed at the tip of syringe (14) and formed to be removable at the aforesaid lower bracket (3).

4 Claims, 4 Drawing Sheets

LIQUID MATERIAL DISPENSING APPARATUS

TECHNICAL FIELD OF THE INVENTION

The present invention pertains to a liquid dispenser for dispensing and coating liquids such as adhesives or silicone resin liquids, etc. in tiny quantities with high precision on circuit boards when mounting electronic components, etc.

BACKGROUND OF THE INVENTION

Syringes for despensing liquids in tiny quantities with high precision onto circuit boards have been previously been proposed by the present inventor and others, and one is found in Examined Utility Model Application Hei 5-9099. This art pertains to a container (i.e. syringe) filled with liquid held in an adapter having a valve stem and actuator that raises and lowers the valve stem. A valve mechanism constituted by the aforesaid valve stem and a nozzle at the tip of the syringe opens and closes, and the liquid inside the syringe is dispensed in tiny quantities with high precision.

However, containers (syringes) filled with liquid available on the market come in many different sizes. Among these, the four types most commonly encountered are 50 cc, 30 cc, 10 cc, and 5 cc. To apply the liquid dispenser disclosed in the aforesaid Examined Utility Model Application Hei 5-9099 to these syringes of different sizes one must prepare liquid dispensers fitting the various sizes due to discrepancies in the clamp mechanism holding the syringe or in the valve stem length dimension; this is very troublesome, and preparing a liquid dispenser for each syringe size is very costly, so improvement is required.

Also, in the prior-art liquid dispenser disclosed in the aforesaid Examined Utility Model Application Hei 5-9099, gas pressure for dispensing the liquid remains inside the syringe when replacing a syringe, so the clamp mechanism must be released after releasing this pressure by some means. However, it often happens that an operator forgets to release residual gas pressure inside the syringe, and if the syringe is erroneously removed while gas pressure remains inside the syringe, the syringe violently blows off due to gas pressure at the instant the clamp mechanism is released, and this is very dangerous.

In other words, the present invention considered the aforesaid problems, so its object is to provide a liquid dispenser that enables a single type of liquid dispenser to handle a variety of sizes of syringes by providing a few accessory components for a variety of syringes of different sizes. An additional object is to provide a safe-to-operate liquid dispenser that releases residual gas pressure in a syringe when replacing a syringe. An additional object is to provide a liquid dispenser whose dispensing valve has good responsiveness in opening and closing.

SUMMARY OF THE INVENTION

The present invention used the following sort of method to solve the aforesaid problems. Below, for ease of understanding, explanation shall be provided using the codes used in the working examples and to be described later. That is, the present invention is a liquid dispenser, comprising:

a. a frame formed by upper bracket and lower bracket and designed to conform to the maximum syringe size matching the use objective, b. a body that is removable at the aforesaid frame's upper bracket, and provided at its upper end with a threaded part for installing an actuator and provided at its lower end with an insertion part for insertion into a syringe and an installation part for an attachment, c. an actuator installed at the threaded part provided at the upper end of the aforesaid body, d. a valve stem operated by the aforesaid actuator, and e. a valve seat member installed at the tip of syringe and formed to be removable at the aforesaid lower bracket.

Also, the liquid dispenser is a liquid dispenser in which the actuator consists of an actuator using electromagnetic force, and the actuator is attached to the body by a thread that includes a magnetic force regulation means.

Also, the liquid dispenser is a liquid dispenser incorporating a means for automatically releasing pressure gas in the syringe when the dispensing mechanism consisting of the body, actuator, valve stem, syringe and valve seat member is removed from the frame.

Also, the liquid dispenser is a liquid dispenser in which an attachment conforming to a different size syringe is provided and is freely removable from the body.

DETAIL DESCRIPTION OF THE PREFERRED EMBODIMENTS

Figure 1:
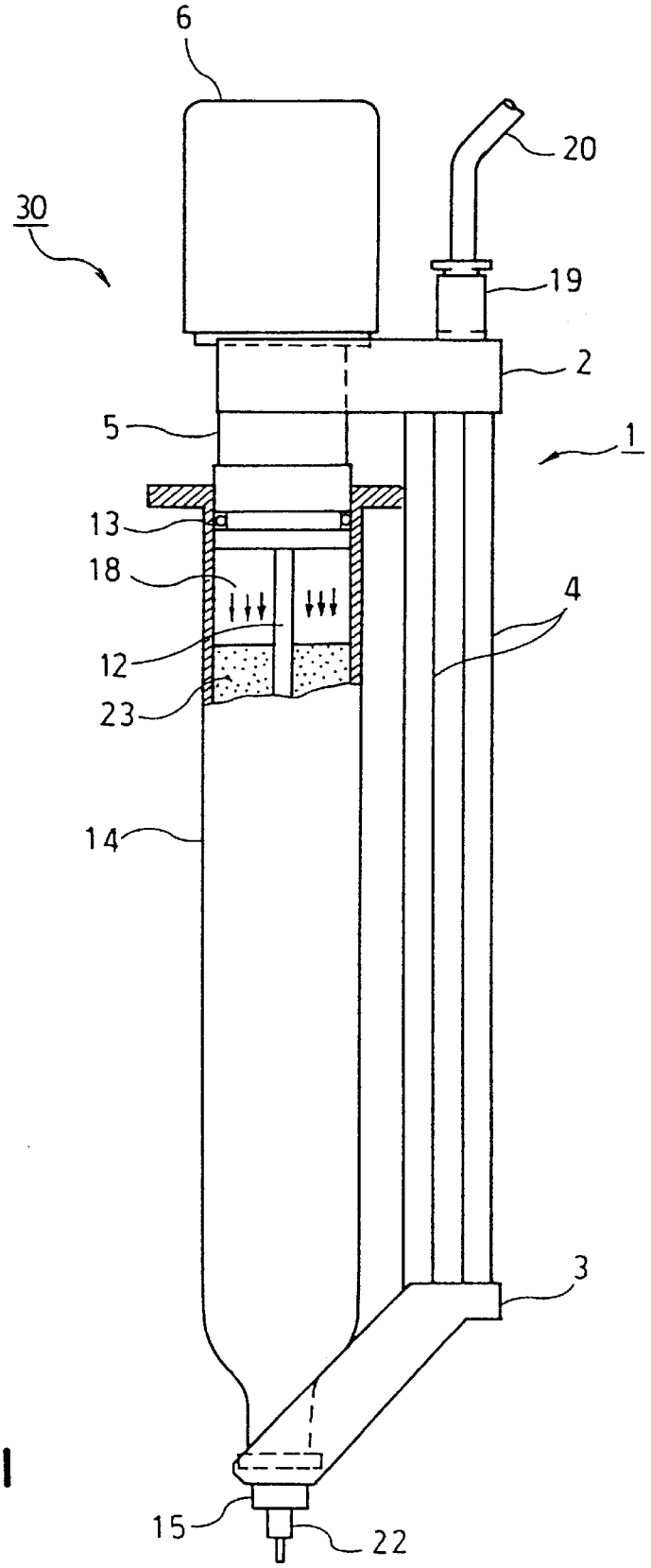
FIG. 1 is a partially sectioned side view of a liquid dispenser constructed in accordance with the invention.

Next, embodiments of the present invention shall be explained. In the present invention, first, the syringe (14) filled with liquid is prepared. Syringes previously filled with liquid are commercially available. Then the valve seat member (15) is screwed onto and attached to the tip of the syringe, and then the lower end insertion part of the body (5) is inserted into the upper end interior of the syringe; the valve stem (12) and actuator (6) have previously been added to the body (5). This assembly constitutes the dispensing mechanism (30). That is, the dispensing mechanism (30) consists of the actuator (6), body (5), valve stem (12), syringe (14) and valve seat member (15).

Next, the dispensing mechanism (30) is installed in the frame (1). That is, the valve seat member (15) that constitutes the dispensing mechanism (30) is installed in the frame (1)'s lower bracket (3), and the body (5) is installed in the upper bracket (2). Then the liquid in the syringe (14) is constantly pressurized by a pressure gas source not shown in the drawing, and the actuator (6) is operated by signals from a control device not shown in the drawing, and if the valve stem (12) is opened the valve mechanism opens and liquid in the syringe (14) is dispensed from the nozzle.

Also, the actuator (6) consists of an electromagnetic actuator. The electromagnetic actuator is screwed on and attached at a threaded part of or actuator installation at the top of the body (5). Magnetic force can be regulated by regulating the screw-in amount of this installation thread, and high-speed responsiveness can be increased by regulating the magnetic force. A means for automatically releasing pressure gas in the syringe when the dispensing mechanism (30) is removed from the frame (1) automatically releases pressure gas in the syringe when the dispensing mechanism (30) is removed from the frame (1) and prevents careless accidents.

Also, to explain the use of different size syringes, a syringe (24) that is small compared to the syringe (14) described earlier is selected and used. Aside from preparing an attachment (16) conforming to each respective syringe (24) of different size, all of the previously described liquid dispensers can be used. Furthermore, the attachment thread of the valve seat member (15) provided at the lower end of the syringe (24) is manufactured to the same dimensions conforming to the standard even if the syringe size differs. The adapter (16) conforming to the small syringe (24) is installed at an attachment installation part provided at the lower end of the body (5), and the lower end of the attachment (16) is inserted into the upper part of the syringe (24).

Using the attachment (16) means that the dimension between the body (5) and the valve seat member (15) due to the frame (1) is controlled and does not change, even with a different-sized syringe, so the length of the valve stem (12) does not change. Therefore it is possible to use the same valve stem (12).

EXAMPLES

Figure 2:
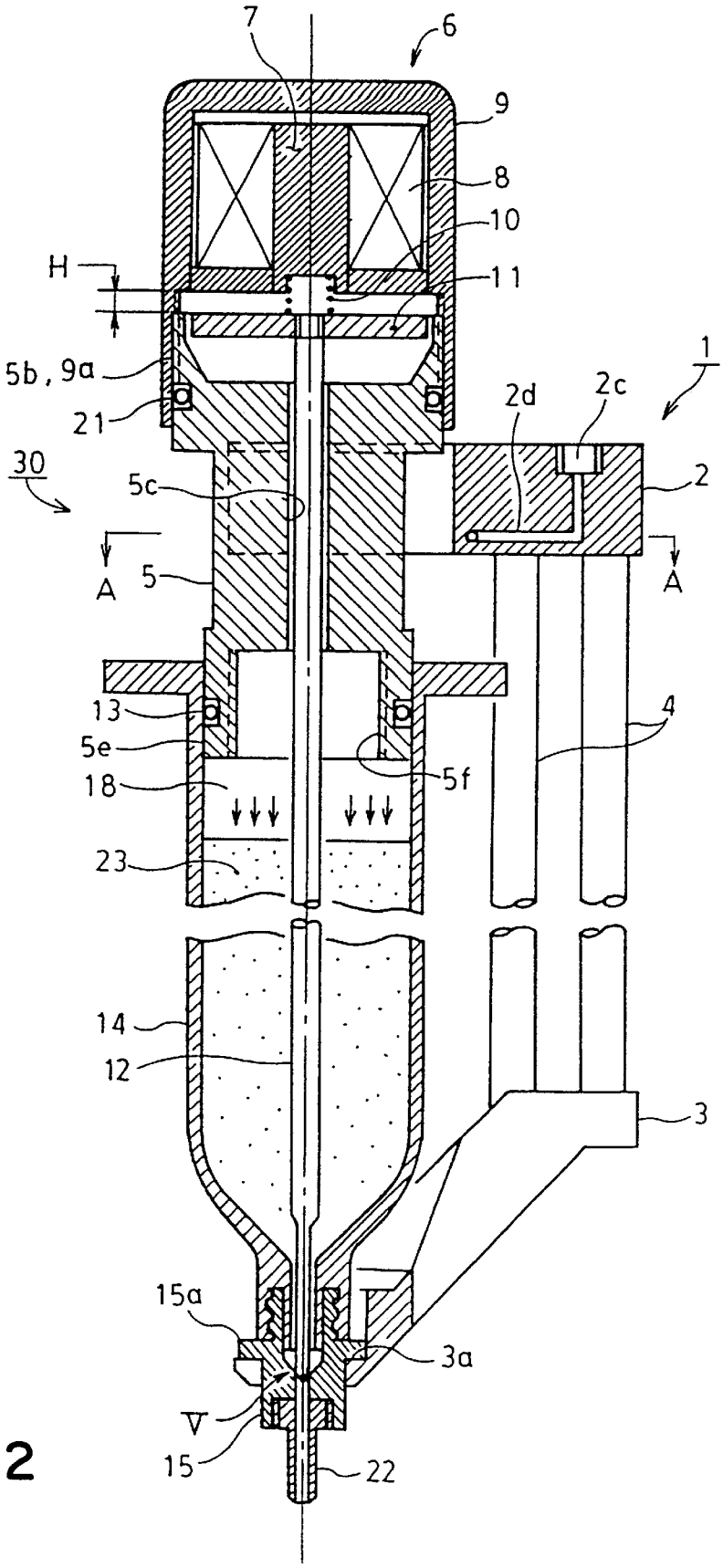
FIG. 2 is an enlarged partial sectional view of the liquid dispenser shown in FIG. 1.

Below, working examples of liquid dispensers in accordance with the present invention shall be explained in detail using drawings. That is, FIG. 1 is a drawing showing the overall structure of a liquid dispenser in accordance with the present invention, FIG. 2 is an enlarged partial sectional view of FIG. 1, FIG. 3 is a sectional view of A—A in FIG. 2, and FIG. 4 is a drawing showing a partial sectional view when using a different size syringe.

In the drawings 2 indicates the upper bracket and 3 is the lower bracket. The upper bracket 2 and lower bracket 3 are strongly bound and integrated by a plurality of tie rods 4. In this working example the frame 1 is constituted using the upper bracket 2 and lower bracket 3 and tie rods 4, but this is due to manufacturing circumstances, and is not limited to this sort of structure. For example, it may also be integrally structured using the die molding method, welding, etc.

If a plurality of different sized syringes are to be used, the frame 1 must be designed so as to conform to the largest syringe. Furthermore, the syringe 14 is filled in advance with a liquid 23. A plurality of types of syringes with different volumes and sizes are commercially available; they are selected and used according to the use objective.

Figure 3:
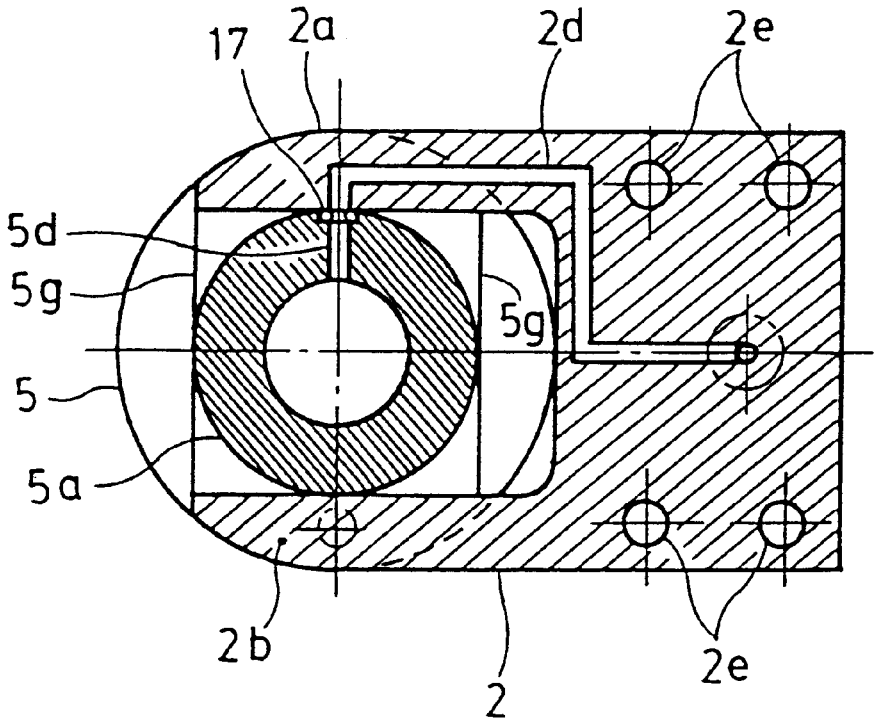
FIG. 3 is a cross sectional view taken along line A—A of FIG. 2.
Figure 4:
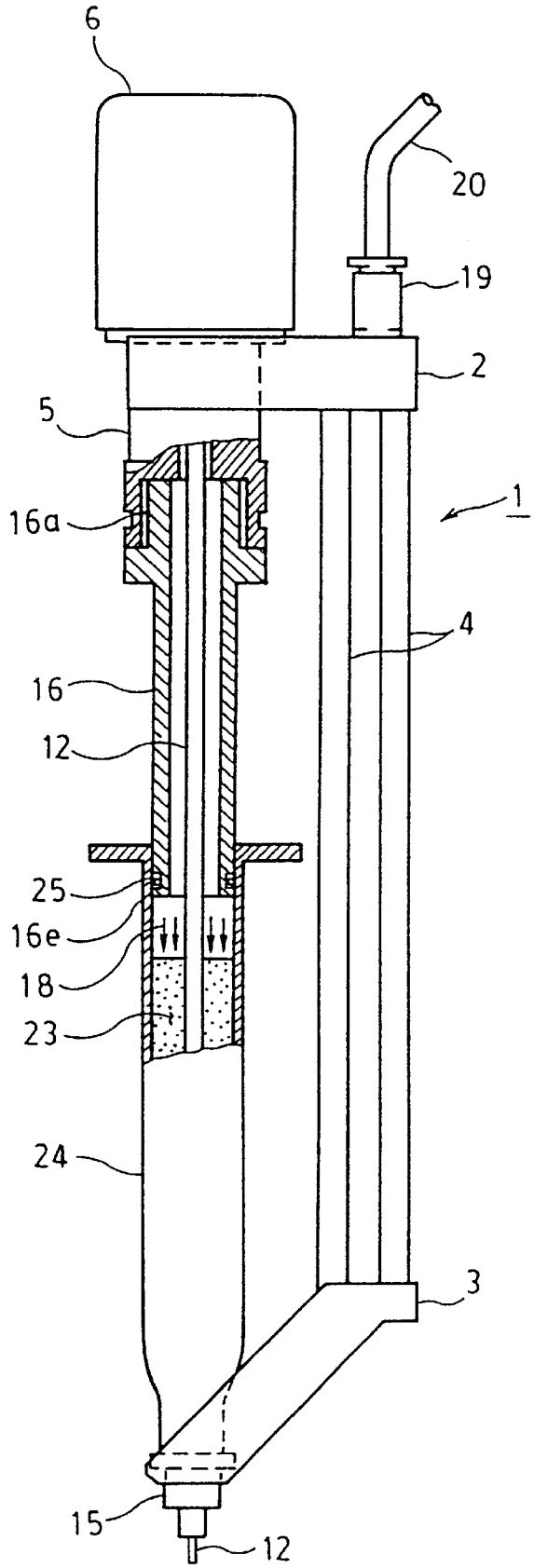
FIG. 4 is a partially sectioned side view showing another embodiment of the invention.

As can be seen in FIG. 3, the upper bracket 2 is formed by bifurcated parts 2*a* and 2*b*, bifurcatingly divided, whose tip portions form a U shape when installed on the body 5. This will be described later, but also provided are a threaded hole 2*c* and a passage 2*d* for supplying a pressure gas 18 inside the syringe 14 via the body 5. Also provided is the tie rod 4's attachment hole 2*e*. The threaded hole 2*c* is connected to a pressure gas supply source outside the drawing via a pipe joint 19 and hose 20.

Next, 5 indicates the body. A through hole 5*c*, penetrated by the valve stem 12, is provided in the center of the body 5, and a neck 5*a* is formed to be freely removable between the bifurcated parts 2*a* and 2*b* of the aforesaid upper bracket 2. When installed, it can be vertically positioned with respect to the upper bracket 2. In addition, a gas hole 5*d* is provided that communicates with the upper bracket 2's passage 2*d* when installed; a seal member (O ring) 17 is installed at the portion facing the passage 2*d*.

Also, a male threaded part 5*b* is provided in the top of the body 5 for installing the actuator 6. In addition, the outer diameter of the body 5's lower end is formed as an insertion part 5*e* so that it can be inserted into and removed from the inner diameter of the syringe 14, and a seal member (O ring) 13 is installed so that pressure gas 18 inside the syringe 14 does not leak out during use. Also, a female thread 5*f* is provided in the inner diameter of the body 5's lower end for installing the attachment 16 that is used when using a syringe of different size, to be described later. Furthermore, the installation means for installing the attachment 16 is not limited to a thread means; other installation means can also be used.

As described earlier, the actuator 6 is installed at the top of the body 5. In this working example an electromagnetic actuator is used as the actuator 6, for example, but it is not limited to this. A hydraulic piston, etc. utilizing pressurized air or pressurized liquid, etc. can also be used, for example. Furthermore, an electromagnetic actuator has the advantage of high-speed responsiveness compared to an actuator of the hydraulic piston type. The actuator 6 consists of a core 7, electromagnetic coil 8, cap 9, and armature 11, etc.; the core 7, electromagnetic coil 8, and cap 9 are integrally formed. Also, a spring 10 is installed between the core 7 and armature 11. The female thread 9*a* formed at the cap 9 is screwed on and attached to male threaded part 5*b* of the aforesaid body 5. Item 21 is a seal member (O ring). The seal member 21 prevents the pressure gas 18 inside the syringe 14 from leaking out from the actuator 6 via the body 5's through hole 5*c* when the dispenser is in use.

Item 12 is a valve stem; the valve stem 12 is linked to the armature 11. The armature 11, together with the valve stem 12, is constantly biased downward by the spring force of the spring 10, and when the actuator 6's electromagnetic coil 8 is magnetized it is pulled upward by electromagnetic force. The distance H between the actuator 6 and the armature 11 can be regulated by regulating the screw-in amount of female thread 9*a* formed in the aforesaid actuator 6's cap 9 and the body 5's male threaded part 5*b*, and this regulates the magnetic force of the actuator 6. That is, if the value of distance H is small, the attractive force of the armature 11 due to magnetic force is strengthened and high-speed responsiveness can be increased, and if the value of distance H is large the attractive force can be weakened.

Item 15 is a valve seat member screwed in and attached to the tip of the syringe 14; the valve seat member 15 forms a valve mechanism V that works with the tip of the aforesaid valve stem 12. Also, a flange 15*a* with a large outer diameter is formed in the middle part of the valve seat member 15; the flange 15*a* can be freely removed at the lower bracket 3's shoulder support seat 3*a*. By installing the valve seat member 15 in the lower bracket 3's shoulder support seat 3*a* the vertical relationship position between the body 5 and the valve seat member 15 is fixed. Furthermore, the shoulder support seat 3*a*, like the aforesaid upper bracket 2, also has a tip part formed in an open U shape, making removal of the valve seat member 15 easy.

Item 22 indicates a nozzle attached to the valve seat member 15; the nozzle 22 is one prepared in advance, with different sizes for nozzle hole diameter and length, etc., and is selected and used according to the use objective.

Next, to explain the operation of a working example thus constituted, first, the valve seat member 15 with the nozzle 22 attached is screwed on and attached to the tip of the syringe 14 filled with the liquid 23, and then the insertion part 5*e* of the body 5, to which the valve stem 12 and actuator 6 have already been added, is inserted into the inner diameter at the top of the syringe 14. This state constitutes the dispensing mechanism 30. That is, the dispensing mechanism 30 consists of the actuator 6, body 5, valve stem 12, syringe 14, and valve seat member 15. Then the tip of the valve stem 12 is pressed at the valve seat member by the spring force of the spring 10, and the valve mechanism V becomes closed.

Next, the dispensing mechanism 30, which incorporates the actuator 6, body 5, valve stem 12, syringe 14, and valve seat member 15, is installed on the frame 1. That is, the valve seat member 15 is installed in the lower bracket 3's shoulder support seat 3a, and the body 5's neck 5*a* is installed between the upper bracket 2's bifurcated parts 2*a* and 2*b*.

Furthermore, this is not described in detail in the drawing, but the relationship between the upper bracket 2 and the body 5 is structured so that a two-sided cut part 5*g* formed in the cylinder of the body 5 matches and is inserted between the upper bracket 2's bifurcated parts 2*a* and 2*b,* and is positioned and fixed at a specified position by a spring lock pin when rotated 90°. It is structured so that when removing it, it cannot be removed until the body 5 has been rotated 90°. Therefore when the body 5 is inserted between the upper bracket 2's bifurcated parts 2*a* and 2*b* and rotated 90°, the gas hole 2*c* of the body 5 and the upper bracket 2's passage 2*d* are automatically positioned to match up with one another and communicate.

Next, after the dispensing mechanism 30 is installed in the frame 1, the pressure gas 18 is supplied from a pressure gas source not shown in the drawing via the hose 20 and joint 19. The pressure gas 18 is supplied to the interior of the syringe 14 via the upper bracket 2's passage 2*d,* gas hole 5*d,* and through hole 5*c,* and the liquid 23 inside the syringe 14 is constantly pressurized. Then, when the actuator 6's electromagnetic coil 8 is magnetized by a signal from a control device outside the drawing, the armature 11 and valve stem 12 are pulled upward and the valve mechanism V opens and the liquid 23 inside the syringe 14 is dispensed from the nozzle 22.

Next we shall explain the procedure for replacement with a new syringe when the liquid inside the syringe is exhausted, etc. First, the body 5 installed between the upper bracket 2's bifurcated parts 2*a* and 2*b* is rotated 90°, and the two-sided cut part 5*g* formed in the cylinder of the body 5 matches between the bifurcated parts 2*a* and 2*b,* and the dispensing mechanism 30 is removed from the frame 1. When this occurs, the position of the upper bracket 2's passage 2*d* and the body 5's gas hole 2*c* become offset due to the 90° rotation, and the pressure gas 18 in the syringe 14 is released from the gas hole 2*c* to the atmosphere, and the pressure inside the syringe becomes zero. Therefore the prior-art problem of a syringe violently blowing off due to increased gas pressure is eliminated. The removed dispensing mechanism 30 is then disassembled into the valve seat member 15, syringe 14, body 5, actuator 6, etc., and a new syringe can be replaced.

Next, using a syringe of a different size shall be explained using FIG. 4. That is, FIG. 4 is a drawing showing a partial cross-section when using a syringe of a different size. In the drawing 16 indicates an attachment and 24 is a syringe of a different size; the syringe 24 has a shape that is smaller compared to the previously described syringe 14. Item 25 is a seal member (O ring). Constituent components used other than the attachment 16, syringe 24, and seal member 25 are exactly the same as those shown in FIG. 1. Furthermore, the attachment thread of the valve seat member 15 provided at the lower end of the syringe 24 is manufactured to the same dimensions conforming to the standard even if the syringe size is different.

Also, a male threaded part 16*a* is provided at the upper end of the attachment 16, and is attached by screwing onto a female threaded part 5*f* provided at the lower end of the body 5. Furthermore, the means for installing the attachment 16 on the body 5 can be a method other than a thread method. Also, the upper part of the syringe 24, which is provided with an insertion part 16*e,* is inserted into the lower end of the attachment 16. Using the attachment 16 means that the dimension between the body 5 and the valve seat member 15 due to the frame 1 is controlled and does not change, even with a different-sized syringe, so the length of the valve stem 12 does not change. Therefore it is possible to use the same valve stem 12.

Aside from providing the attachment the operation is the same as the previously described case without an attachment, so explanation thereof shall be omitted. Also, regardless of how the syringe size changes, it is possible to constitute a liquid dispenser simply by preparing attachments conforming to syringe size, so the present invention has a great advantage with regard to cost.

As explained above, the present invention's liquid dispenser provides a liquid dispenser that can handle a variety of types of syringe size; the frame is manufactured to match the size of the largest syringe, and an attachment conforming to small syringes is prepared. Also, when the dispensing mechanism is removed from the frame, the body is rotated 90°, thereby automatically releasing the pressure gas inside the syringe, so the syringe does not blow off due to gas pressure and it is safe. In addition, if the actuator is constituted as an electromagnetic actuator, the gap between the armature and the electromagnetic coil can be freely regulated by the actuator's attachment screw's screw-in amount, so the strength or weakness of the magnetic force acting on the actuator can be regulated, and it is possible to speed up the operational response speed.

While the present invention has been illustrated by a description of various preferred embodiments and while these embodiments has been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

I claim:

1. A liquid dispenser with a syringe reservoir, comprising:

a frame formed by an upper bracket and a lower bracket;

a body connected in a removable manner at said upper bracket, and having an upper end with a threaded part and a lower end with an insertion part for insertion into a syringe;

an actuator coupled to said threaded part provided at said upper end of said body;

a valve stem operated by said actuator; and a valve seat member formed to be removable at said lower bracket.

2. A liquid dispenser as set forth in claim 1, wherein said valve stem carries an armature and said actuator further comprises an electromagnetic actuator including a coil, and said actuator is attached to said body in a manner allowing adjustment in the position of the coil relative to the armature thereby regulating a magnetic force.

3. A liquid dispenser as set forth in claim 1 further comprising means for automatically releasing gas pressure in the syringe when said body, said actuator, said valve stem, said syringe and said valve seat member are removed from said frame.

4. A liquid dispenser as set forth in claim 1 further comprising an attachment conforming to a different size syringe, said attachment being removable from said body.

* * * * *

UNITED STATES PATENT AND TRADEMARK OFFICE

CERTIFICATE OF CORRECTION

PATENT NO. : 6,354,471 B2
DATED : March 12, 2002
INVENTOR(S) : Hideyo Fujii

It is certified that error appears in the above-identified patent and that said Letters Patent is hereby corrected as shown below:

Column 1,
Lines 10-20, delete the first paragraph after "BACKGROUND OF THE INVENTION" and insert -- Art for dispensing and coating liquids stored in a small container known as a syringe in tiny quantities with high precision on a board has previously been proposed by the present inventor and others, and is found in Examined Utility Model Application Hei 5-9099. This art pertains to a container (i.e. syringe) filled with liquid held in an adapter having a valve stem and actuator that raises and lowers the valve stem as constituent features; a valve mechanism constituted by the aforesaid valve stem and a nozzle at the tip of the syringe opens and closes, and the liquid inside the syringe is dispensed and coated in tiny quantities with high precision. --.

Column 2,
Line 58, change "of or" to -- for --.
Line 62, delete "A" and insert therefor -- Also, incorporating in the aforesaid liquid dispenser a --.

Column 3,
Line 33, after "rods 4" insert -- and constitute the frame 1 --.

Signed and Sealed this

First Day of April, 2003

JAMES E. ROGAN
*Director of the United States Patent and Trademark Office*